US005899127A

United States Patent [19]

Shiao

[11] Patent Number: 5,899,127

[45] Date of Patent: May 4, 1999

[54] VARIABLE-LENGTH SCREWDRIVER

[76] Inventor: Hsuan-Sen Shiao, No. 15-1, Lane 369, Min-Chuan Rd., Taichung City, Taiwan

[21] Appl. No.: 09/045,936

[22] Filed: Mar. 23, 1998

[51] Int. Cl.[6] ..... B25G 1/08

[52] U.S. Cl. ..... 81/490; 81/177.4; 81/438

[58] Field of Search ..... 81/490, 177.4, 81/438, 439, 177.2, 492, 437

[56] References Cited

U.S. PATENT DOCUMENTS

| | | | |
|---|---|---|---|
| 2,022,775 | 2/1935 | Holland-Letz | 81/439 |
| 4,399,723 | 8/1983 | Marleau | 81/437 |
| 5,499,562 | 3/1996 | Feng | 81/177.4 |

*Primary Examiner*—David A. Scherbel
*Assistant Examiner*—Sinclair Skinner
*Attorney, Agent, or Firm*—Baker & Botts, L.L.P.

[57] ABSTRACT

A variable-length screwdriver includes a shank and a handle. The shank has a handle mounting portion. The handle includes a handle base mounted securely on the handle mounting portion and at least one movable block. The handle base includes a front plug section, and a rear socket section disposed rearwardly of the front plug section and having a rear end face formed with a base socket. The front plug section and the base socket have complementary non-circular cross-sections in a direction transverse to the axis of the shank. The movable block includes a front plug portion, a rear socket portion disposed rearwardly of the front plug portion and having a rear end face formed with a block socket, and a shank hole that extends axially through the front plug portion and the rear socket portion. The front plug portion and the block socket have cross-sections in the direction transverse to the axis of the shank that correspond to the cross-sections of the front plug section and the base socket. The movable block is movable from a first position, where the front plug portion extends fittingly and removably into the base socket, to a second position, where the shank extends through the shank hole of the movable block and the front plug section extends fittingly and removably into the block socket.

11 Claims, 8 Drawing Sheets

VARIABLE-LENGTH SCREWDRIVER

BACKGROUND OF THE INVENTION

1. Field of the Invention

The invention relates to a screwdriver, more particularly to a variable-length screwdriver.

2. Description of the Related Art

A conventional screwdriver includes a shank with a tool bit mounting portion and a handle mounting portion opposite to the tool bit mounting portion, and a handle mounted securely on the handle mounting portion of the shank.

The length of the shank of the conventional screwdriver is usually fixed. Thus, the consumer usually owns a number of screwdrivers having shanks of different lengths in order to reach different types of screws.

SUMMARY OF THE INVENTION

Therefore, the object of this invention is to provide a variable-length screwdriver capable of overcoming the aforementioned drawback that is generally associated with the conventional screwdrivers.

Accordingly, the variable-length screwdriver of this invention includes a shank and a handle. The shank has a tool bit mounting portion and a handle mounting portion opposite to the tool bit mounting portion. The handle includes a handle base and a least one movable block. The handle base is mounted securely on the handle mounting portion of the shank. The handle base includes a front plug section, and a rear socket section which is disposed rearwardly of the front plug section and which has a rear end face formed with a base socket. The front plug section and the base socket have complementary non-circular cross-sections in a direction transverse to the axis of the shank. The movable block includes a front plug portion and a rear socket portion which is disposed rearwardly of the front plug portion and which has a rear end face formed with a block socket. A shank hole extends axially through the front plug portion and the rear socket portion. The front plug portion and the block socket have cross-sections in the direction transverse to the axis of the shank that correspond to the cross-sections of the front plug section and the base socket. The movable block is movable from a first position, where the front plug portion extends fittingly and removably into the base socket, to a second position, where the shank extends through the shank hole of the movable block and the front plug section extends fittingly and removably into the block socket. An effective length of the shank is reduced when the movable block is at the second position.

BRIEF DESCRIPTION OF THE DRAWINGS

Other features and advantages of this invention will become more apparent in the following detailed description of the preferred embodiment of this invention, with reference to the accompanying drawings, in which.

DETAILED DESCRIPTION OF THE PREFERRED EMBODIMENT

Figure 1:
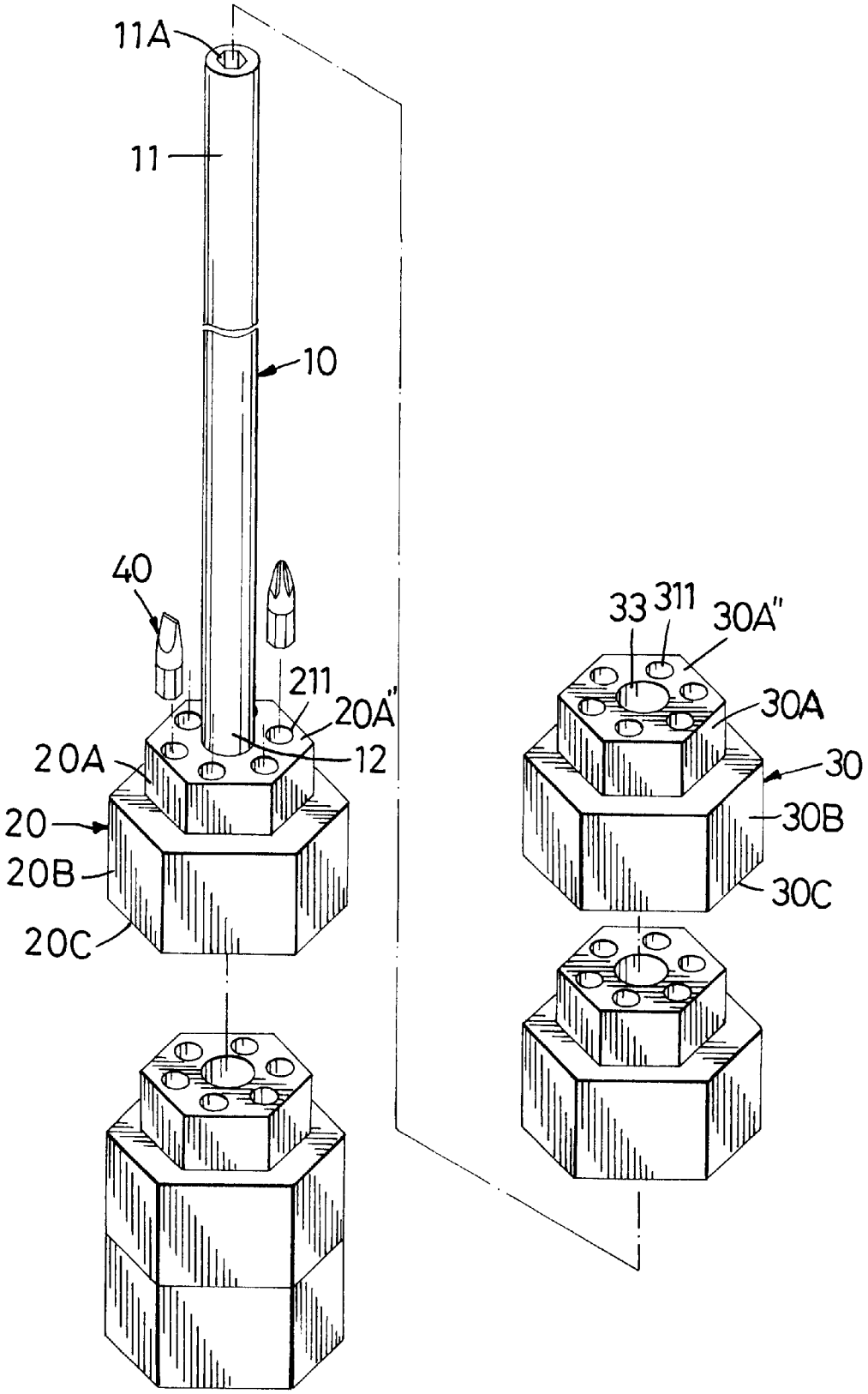
FIG. 1 is an exploded view of a preferred embodiment of a variable-length screwdriver according to this invention.
Figure 2:
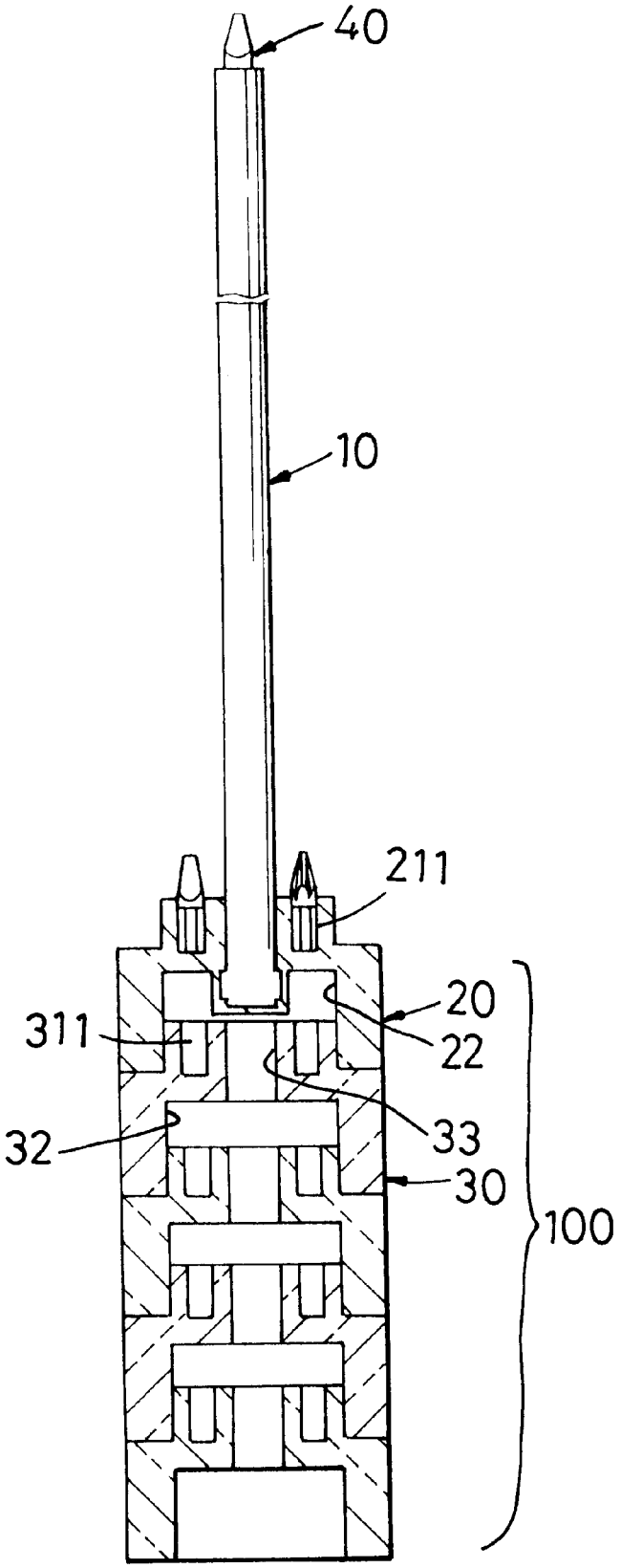
FIG. 2 is a sectional view of the preferred embodiment.

Referring to FIGS. 1 and 2, the preferred embodiment of a variable-length screwdriver of this invention is shown to include a shank 10 and a handle 100.

As illustrated, the shank 10 has a tool bit mounting portion 11 and a handle mounting portion 12 opposite to the tool bit mounting portion 11.

The handle 100 includes a handle base 20 and four movable blocks 30. The handle base 20 is mounted securely on the handle mounting portion 12 of the shank 10, and includes a front plug section 20A, and a rear socket section 20B which is disposed rearwardly of the front plug section 20A and which has a rear end face 20C formed with a base socket 22. The front plug section 20A and the base socket 22 have complementary non-circular cross-sections in a direction transverse to the axis of the shank 10.

Figure 3:
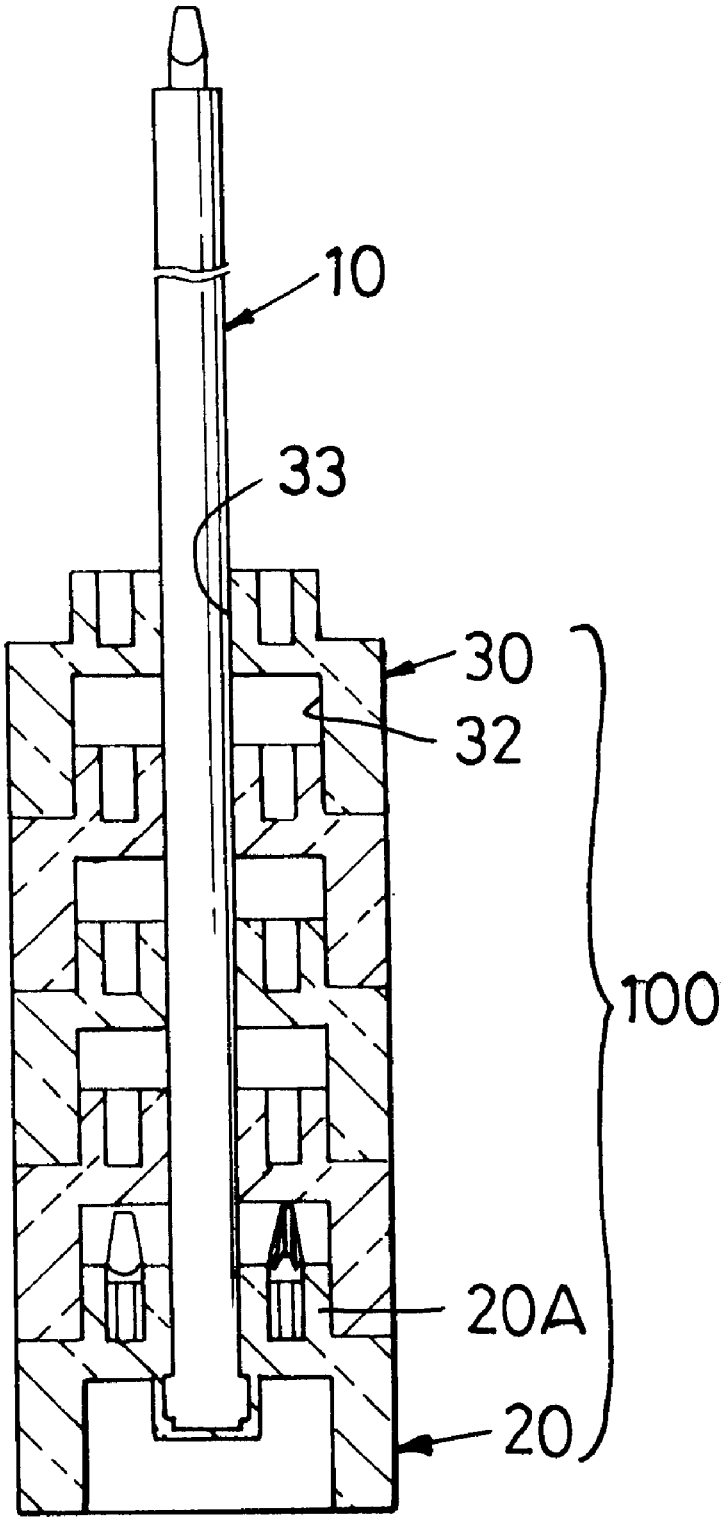
FIGS. 3 and 4 are sectional views of the preferred embodiment, illustrating how an effective length of the shank is varied.

Each of the movable blocks 30 includes a front plug portion 30A, a rear socket portion 30B which is disposed rearwardly of the front plug portion 30A and which has a rear end face 30C formed with a block socket 32, and a shank hole 33 that extends axially through the front plug portion 30A and the rear socket portion 30B. The front plug portion 30A and the block socket 32 have cross-sections in the direction transverse to the axis of the shank 10 that correspond to the cross-sections of the front plug section 20A and the base socket 20B. Each movable block 30 is movable from a first position rearwardly of the handle base 20, as best shown in FIG. 2, and a second position forwardly of the handle base 20, as best shown in FIG. 3. In the first position, the front plug portion 30A extends fittingly and removably into the adjacent one of the base socket 22 and the block socket 32. In the second position, the shank 10 extends through the shank hole 33, and the adjacent one of the front plug section 20A and the front plug portion 20A extends fittingly and removably into the block socket 32.

Figure 4:
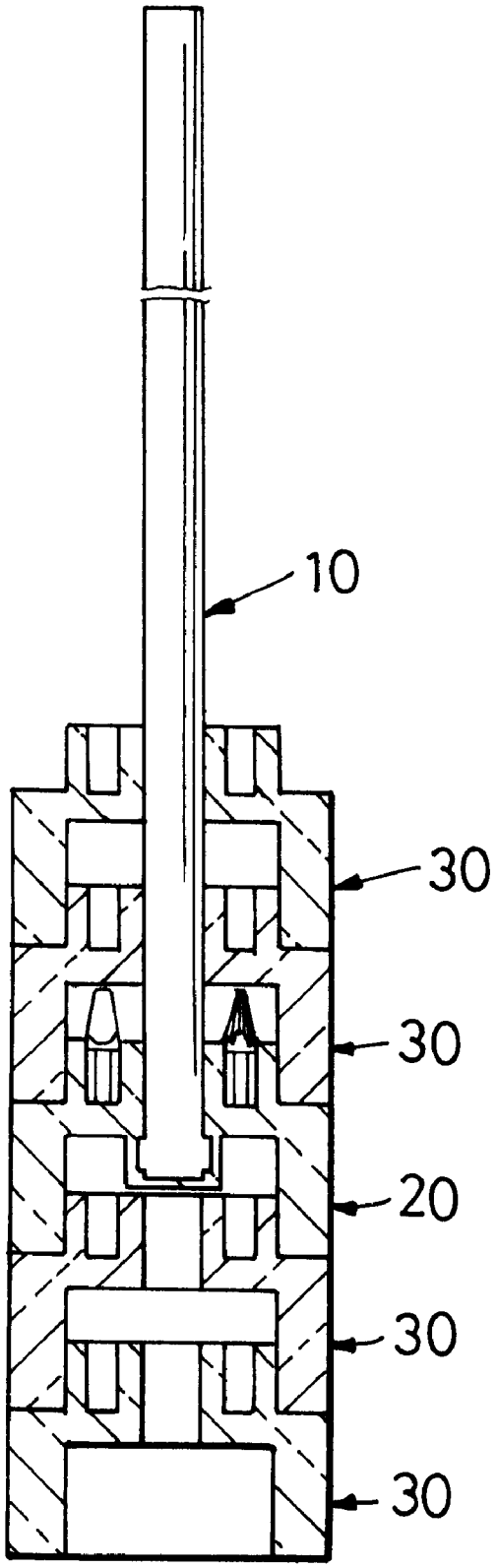

Note that an effective length of the shank 10 is reduced when the movable blocks 30 are at the second position. As shown in FIG. 4, two of the movable blocks 30 are at the first position while the remaining two are at the second position so as to result in an effective shank length 10 that is shorter than shown in FIG. 2 but longer than that shown in FIG. 3. The non-circular cross-sections of the front plug section 20A, the base socket 22, the front plug portion 30A and the block socket 32 prevent relative rotation among the handle base 20 and the movable blocks 30.

Referring again to FIGS. 1 and 2, the preferred embodiment further includes a plurality of tool bits 40, each of which is mounted removably and selectively on the tool bit mounting portion 11 of the shank 10. The tool bit mounting portion 11 is formed with a tool bit hole 11A of non-circular cross-section in a direction transverse to the axis of the shank 10 to engage the mounting end of the selected tool bit 40. Each of the front plug section 20A and the front plug portions 30A of the movable blocks 30 has a front end face 20A", 30A" formed with a plurality of bit retaining holes 211, 311 offset to the axis of the shank 10 for retaining removably the non-selected tool bits 40 on the handle 100.

An important aspect to note is that the base socket 22 and the block socket 32 of each movable block 30 should be formed with a depth sufficient to accommodate the non-selected tool bits 40 when the latter are retained on the handle 100. Preferably, the handle base 20 and the movable blocks 30 are made from a transparent material so that the non-selected tool bits 40 on the handle 100 are visible from an exterior of the handle 100.

In the preferred embodiment, the non-circular cross-sections of the handle base 20 and the movable blocks 30 are polygons, preferably hexagons. Moreover, the outer wall surface of the rear socket section 20B is flush with the profiles of the rear socket portions 30B of the movable blocks 30 in order to facilitate firm gripping of the handle 100.

Figure 5:
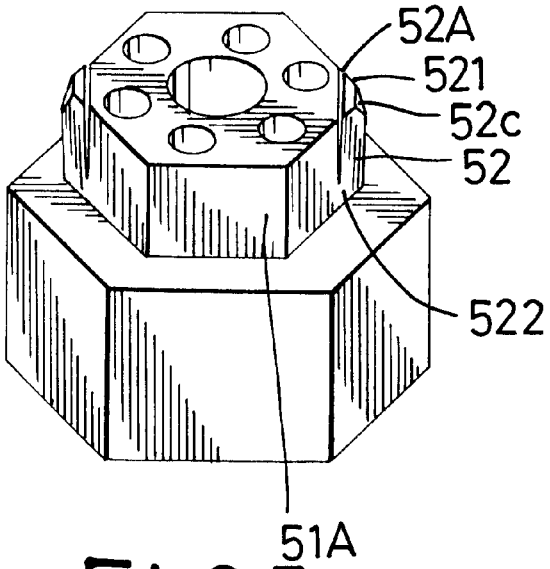
FIG. 5 shows a movable block employed in the preferred embodiment.

In a preferred embodiment of this invention, the periphery 51A of the front plug section and the plug portion of each movable block is provided with two resilient members 52 (see FIG. 5) to engage frictionally the respective one of the base socket 22 and the block socket 32 (see FIG. 1). Each of the resilient members 52 forms a clearance 52A with the periphery 51A of the respective one of the front plug section and the front plug portion (see FIG. 1), and has a connecting end 522 connected integrally with the respective one of the front plug section and the front plug portion, and a distal end 521 opposite to the connecting end 522. The distal end 521 of the resilient member 52 has an inclined face 52C to facilitate insertion of the respective one of the front plug section and the front plug portion into the corresponding one of the base socket and the block socket.

Figure 6:
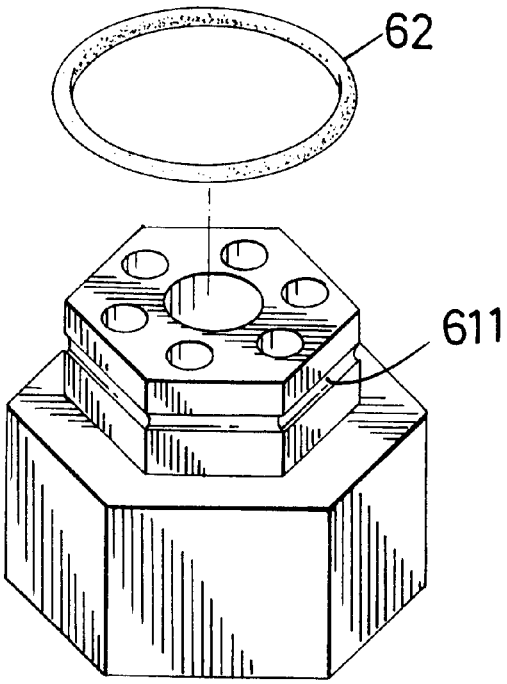
FIG. 6 shows a modified movable block employed in the preferred embodiment.

Referring to FIG. 6, in another preferred embodiment of this invention, the periphery of the front plug section and the front plug portion of each movable block is formed with an annular groove 611 to receive a rubber friction ring 62. The friction ring 62 engages frictionally the respective one of the base socket and the block socket.

Figure 7:
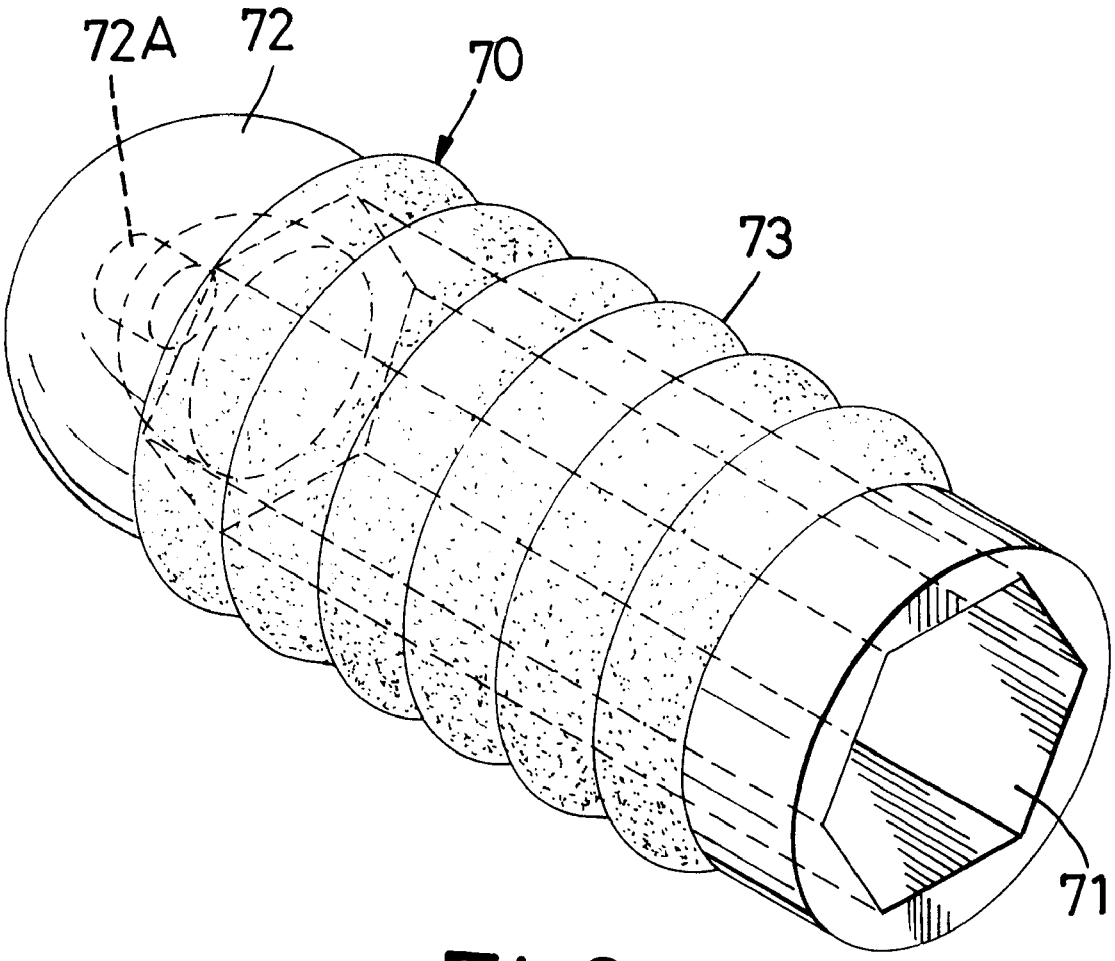
FIG. 7 illustrates a grip sleeve for sheathing on a handle of the preferred embodiment.
Figure 8:
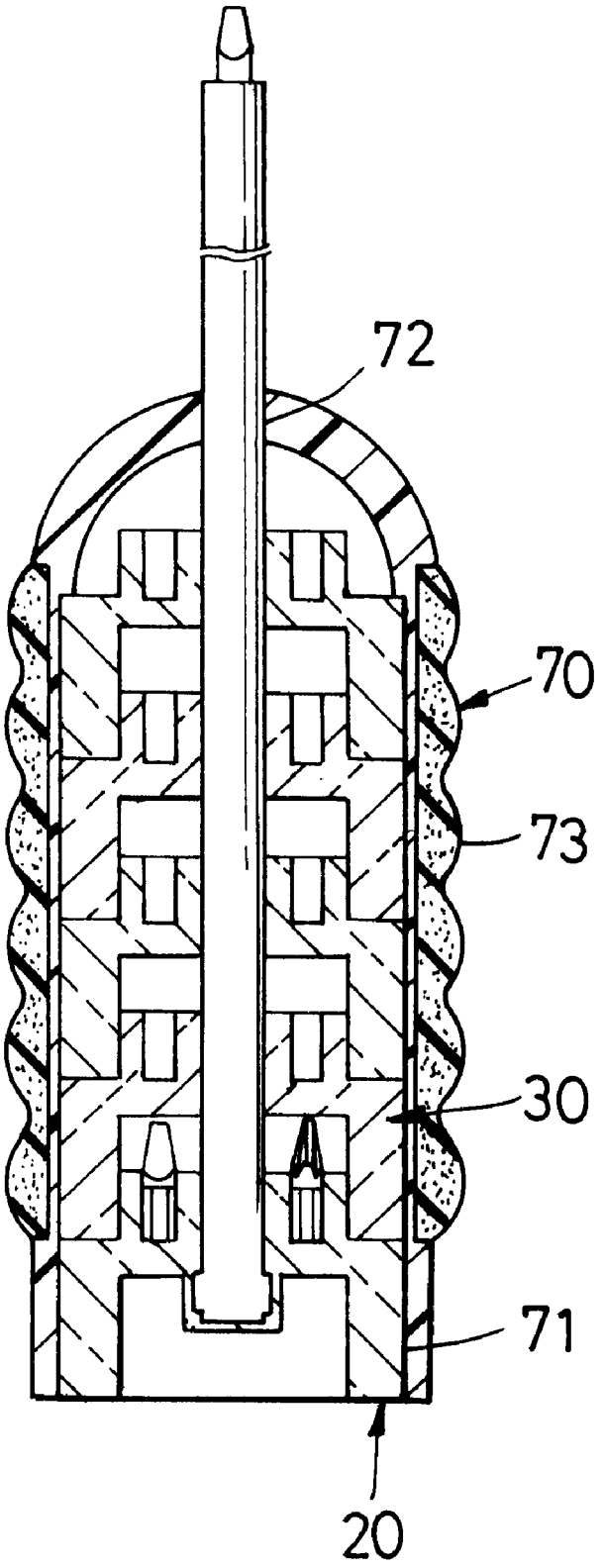
FIGS. 8 and 9 respectively show how the grip sleeve of FIG. 7 is sheathed on the handle of the preferred embodiment.
Figure 9:
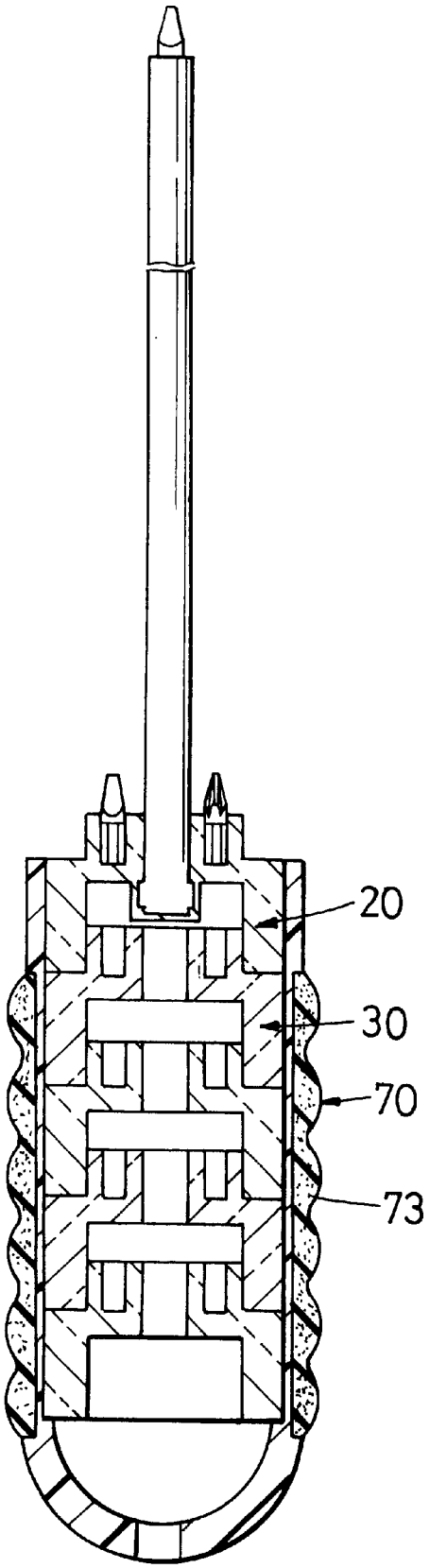

Referring to FIG. 7, the preferred embodiment further includes a grip sleeve 70 sheathed removably on the handle. The grip sleeve 70 includes a tubular body 73 having a first portion 72, a second portion 71, and a handle accommodation hole extending from the second portion 71 toward the first portion 72 and corresponding in profile to the rear socket section 20B and the rear socket portion 30B of the movable blocks 30. The first portion 72 is formed with an axial hole 72A for extension of the shank 10 such that the grip sleeve 70 can be sheathed over the handle base 20 and the movable blocks 30 in two different ways, as best illustrated in FIGS. 8 and 9.

With this invention thus explained, it is apparent that numerous modifications and variations can be made without departing from the scope and spirit of this invention. It is therefore intended that this invention be limited only as indicated in the appended claims.

I claim:

1. A variable-length screwdriver comprising:

a shank having a tool bit mounting portion and a handle mounting portion opposite to said tool bit mounting portion; and a handle including a handle base mounted securely on said handle mounting portion, said handle base including a front plug section, and a rear socket section disposed rearwardly of said front plug section and having a rear end face formed with a base socket, said front plug section and said base socket having complementary non-circular cross-sections in a direction transverse to axis of said shank; and at least one movable block, each including a front plug portion, a rear socket portion disposed rearwardly of said front plug portion and having a rear end face formed with a block socket, and a shank hole that extends axially through said front plug portion and said rear socket portion, said front plug portion and said block socket having cross-sections in the direction transverse to the axis of said shank that correspond to the cross-sections of said front plug section and said base socket, said movable block being movable from a first position, where said front plug portion extends fittingly and removably into said base socket, to a second position, where said shank extends through said shank hole of said movable block and said front plug section extends fittingly and removably into said block socket; and whereby, an effective length of said shank is reduced when said movable block is at said second position.

2. The variable-length screwdriver as defined in claim 1, further comprising a tool bit mounted removably on said tool bit mounting portion of said shank, at least one of said front plug section and said front plug portion having a front end face formed with a bit retaining hole offset to the axis of said shank for retaining removably said tool bit on said handle.

3. The variable-length screwdriver as defined in claim 2, wherein each of said base socket and said block socket has a depth sufficient to accommodate said tool bit when said tool bit is retained on said handle.

4. The variable-length screwdriver as defined in claim 3, wherein said handle is made from a transparent material.

5. The variable-length screwdriver as defined in claim 1, wherein the non-circular cross-sections are polygons.

6. The variable-length screwdriver as defined in claim 5, wherein the polygons are hexagons.

7. The variable-length screwdriver as defined in claim 1, wherein each of said front plug section and said plug portion has a periphery provided with at least one resilient member to engage frictionally the respective one of said rear socket section and said rear socket portion.

8. The variable-length screwdriver as defined in claim 7, wherein said resilient member forms a clearance with the periphery of the respective one of said front plug section and said front plug portion, and has a connecting end connected integrally with the respective one of said front plug section and said front plug portion, and a distal end opposite to said connecting end.

9. The variable-length screwdriver as defined in claim 8, wherein said distal end of said resilient member has an inclined face to facilitate insertion of the respective one of said front plug section and said front plug portion into the corresponding one of said base socket and said block socket.

10. The variable-length screwdriver as defined in claim 1, wherein each of said front plug section and said front plug portion has a friction ring provided therearound to engage frictionally the respective one of said rear socket section and said rear socket portion.

11. The variable-length screwdriver as defined in claim 1, further comprising a grip sleeve sheathed removably on said handle.

* * * * *